United States Patent [19]

Sting

[11] Patent Number: 4,975,984

[45] Date of Patent: Dec. 11, 1990

[54] ONE-PIECE GARMENT

[75] Inventor: Betty J. Sting, Portage, Ind.

[73] Assignee: Betty Sting Patient Gowns, inc., Portage, Ind.

[21] Appl. No.: 379,174

[22] Filed: Jul. 12, 1989

[51] Int. Cl.[5] ..... A41D 10/00; A41D 13/00

[52] U.S. Cl. ..... 2/114; 2/51; 2/69; 2/75; 2/88; 2/105; 2/DIG. 2; 2/DIG. 7

[58] Field of Search ..... 2/48, 50, 51, 69, 70, 2/71, 74, 75, 80, 88, 105, 114, DIG. 2, DIG. 4, DIG. 7

[56] References Cited

U.S. PATENT DOCUMENTS

| | | | |
|---|---|---|---|
| 38,757 | 6/1863 | Osler | 2/DIG. 4 X |
| 1,497,685 | 6/1924 | Hoyme | 2/114 X |
| 1,524,345 | 1/1925 | DuBose | 2/DIG. 2 X |
| 2,269,883 | 1/1942 | Simon | 2/115 |
| 2,282,547 | 5/1942 | Spanel | 2/48 |
| 2,628,359 | 2/1953 | Shalda | 2/80 X |
| 2,675,555 | 4/1954 | Kempner | 2/114 |
| 2,680,850 | 6/1954 | Durand | 2/114 X |
| 2,701,368 | 2/1955 | Swartz | 2/105 X |
| 2,717,390 | 9/1955 | Houze | 2/105 X |
| 3,078,467 | 2/1963 | Artzt | 2/243 |
| 3,339,209 | 9/1967 | Larson | 2/74 |
| 3,557,385 | 1/1971 | Hendrickson | 2/114 |
| 3,781,916 | 1/1974 | Vitol | 2/DIG. 7 |
| 3,820,165 | 6/1974 | Negherbon | 2/DIG. 2 X |
| 4,441,025 | 4/1984 | McCoy, Jr. | 2/51 X |
| 4,473,908 | 10/1984 | Knecht | 2/DIG. 4 X |
| 4,608,719 | 9/1986 | Lunt | 2/DIG. 7 X |
| 4,764,985 | 8/1988 | Wade | 2/88 |
| 4,769,855 | 9/1988 | Tsai | 2/114 |
| 4,771,480 | 9/1988 | Stimson | 2/88 |
| 4,837,863 | 6/1989 | Van Scoy-Mosher | 2/DIG. 7 X |

OTHER PUBLICATIONS

"Fashion Seal Health Care Apparel Catalog 146", pp. 30–43, 82–84.

*Primary Examiner*—Werner H. Schroeder
*Assistant Examiner*—Jeanette E. Chapman
*Attorney, Agent, or Firm*—Wood, Phillips, Mason, Recktenwald & VanSanten

[57] ABSTRACT

A one-piece garment is disclosed. The garment has two panels with a neck opening between the panels. The second panel has a central panel, side panels and transverse panels. The central panel covers the wearer's back and shoulders, the side panels cover the wearer's sides from under the junctions of the wearer's arms and shoulders, and the transverse panels extend substantially across the wearer's chest. The first panel may lie over or under the transverse panels. Means for closing the transverse panels is provided so that the transverse panels may be secured in position across the wearer's chest. In a preferred embodiment, the closure means allows the transverse panels to be closed in two ways: first, with one transverse panel overlying the other; second, in a draw string manner with the outer ends of the transverse panels extending toward each other. The panels of the garment are proportioned to ensure adequate coverage of the wearer.

32 Claims, 2 Drawing Sheets

ONE-PIECE GARMENT

FIELD OF THE INVENTION

This invention relates to garments, and more particularly to one-piece garments to be worn by hospital and clinic patients. The garment of the present invention may be worn by patients confined to hospitals, nursing homes, or extended care facilities, as well as by out-patients at clinics. It may also be used at out-patient testing, diagnostic and treatment facilities and physicians' offices. It may be used for both pediatric and adult patients in these and other settings. Outside of the health care field, it may also be used as a coverup or smock to protect underlying clothing as a children's cover-all for art classes, as a robe, cooking apron, protective garment, and swim suit cover-up.

BACKGROUND OF THE INVENTION

The existing standard hospital gown has traditionally comprised a one-piece, sleeved gown with a gap in the back which is closed by metal snaps or cloth ties. These standard hospital gowns have presented problems to the patients wearing them as well as to the hospital personnel dealing with the gowns. Given the design of the standard hospital gown, the patient's back side is not adequately covered. For the ambulatory patient and for the out-patient undergoing, for example, an X-ray, this standard gown is immodest, and patients may feel that modesty requires use of an additional robe to adequately cover themselves. In hospital maternity wards, this standard gown interferes with nursing mothers' ease of breast-feeding their newborns, since the standard gown is connected at the patient's back.

For the hospital staff, the standard hospital gown presents several problems. Since the gown is closed across the patient's back, the patient's frontal chest area is not readily accessible: the standard gown presents an obstacle to examination, the attachment of emergency cardiac equipment or accessing subclavian lines. The structure of the standard gown requires that the patient's arms be pulled out through the gown's sleeves when the gown is removed for changing: this presents a problem for the patient receiving intravenous treatment through one or both arms, for the gown cannot be easily removed while the intravenous bottle is connected to the patient's arm. Standard gowns using metal snaps for closure may present problems when used with diagnostic equipment such as X-ray, Magnetic Resonance Imaging (MRI) and Cat-scan equipment, for the metal snaps may interfere with the equipment. The standard hospital gown's problems have existed for decades without a meaningful solution.

The gown of the present invention provides a solution to these problems. It provides easy, quick access to the wearer's chest for examination and emergency treatment. It adequately covers the patient on all sides, without leaving any gaps of exposure. It can be removed from the patient and replaced with a clean gown without disturbing intravenous arm connections. It allows for discreet breast feeding for nursing mothers. It does not employ metal snaps which interfere with hospital equipment.

SUMMARY OF THE INVENTION

The present invention provides a one-piece garment having first and second panels. An interior neck opening is provided between the two panels, through which the wearer's neck may extend. The interior neck opening has a peripheral edge with first and second parts on the two panels. The first panel has a peripheral edge including a bottom edge and a first pair of spaced side edges. The first panel extends longitudinally from the first part of the neck edge to the first bottom edge and transversely between the two side edges. The second panel has a peripheral edge including a second bottom edge, a pair of spaced axillar edges extending from the first side edges, a pair of transverse edges extending from the axillar edges, and a second pair of side edges extending from the transverse edges to the bottom edge.

The second panel has a central panel extending longitudinally from the second part of the neck edge to the bottom edge, a pair of spaced integral side panels alongside the central panel and extending longitudinally from the axillar edges to the second bottom edge. A pair of spaced integral transverse panels run along the side panels and extend transversely from the side panels to the second side edges and longitudinally from the transverse edges to the bottom edge.

The first panel is adapted to cover the front of the wearer. The central panel is adapted to cover the wearer's back and shoulders from the neck edge to the second bottom edge. The side panels are adapted to cover the wearer's sides from under the wearer's armpits to the bottom edge, and the transverse panels are adapted to extend from the side panels across at least a substantial part of the wearer's chest. Thus, the second panel wraps around the back, sides and at least a substantial part of the front of the wearer. The garment also includes means for closing the transverse panels across the wearer's chest, either over or under the first panel. In combination, the first and second panels adequately cover the wearer.

With the transverse panels closed under the first panel, access to the wearer's upper chest is available by simply lifting the first panel. The garment may be easily changed since it is only necessary to undo the closure means and lift the garment over the wearer's head; intravenous connections to the wearer's arms may be left intact. The garment adequately covers the wearer, so that no additional covering is required. The transverse panels may also be closed over the first panel. The garment may be reversed with the first panel covering the patient's back, and the transverse panels extending across the patient's back.

The disclosed closure means allows the garment to be used for patients of varying body sizes and weights, and the garment is proportioned so that it may be used for a variety of patients. Generally, to ensure adequate coverage of the wearer, the lengths of the transverse panels are at least one-third of the overall length of the garment and the overall width of the second panel is at least twice the width of the most narrow part of the central panel.

DETAILED DESCRIPTION OF THE ILLUSTRATED EMBODIMENT

Figure 1:
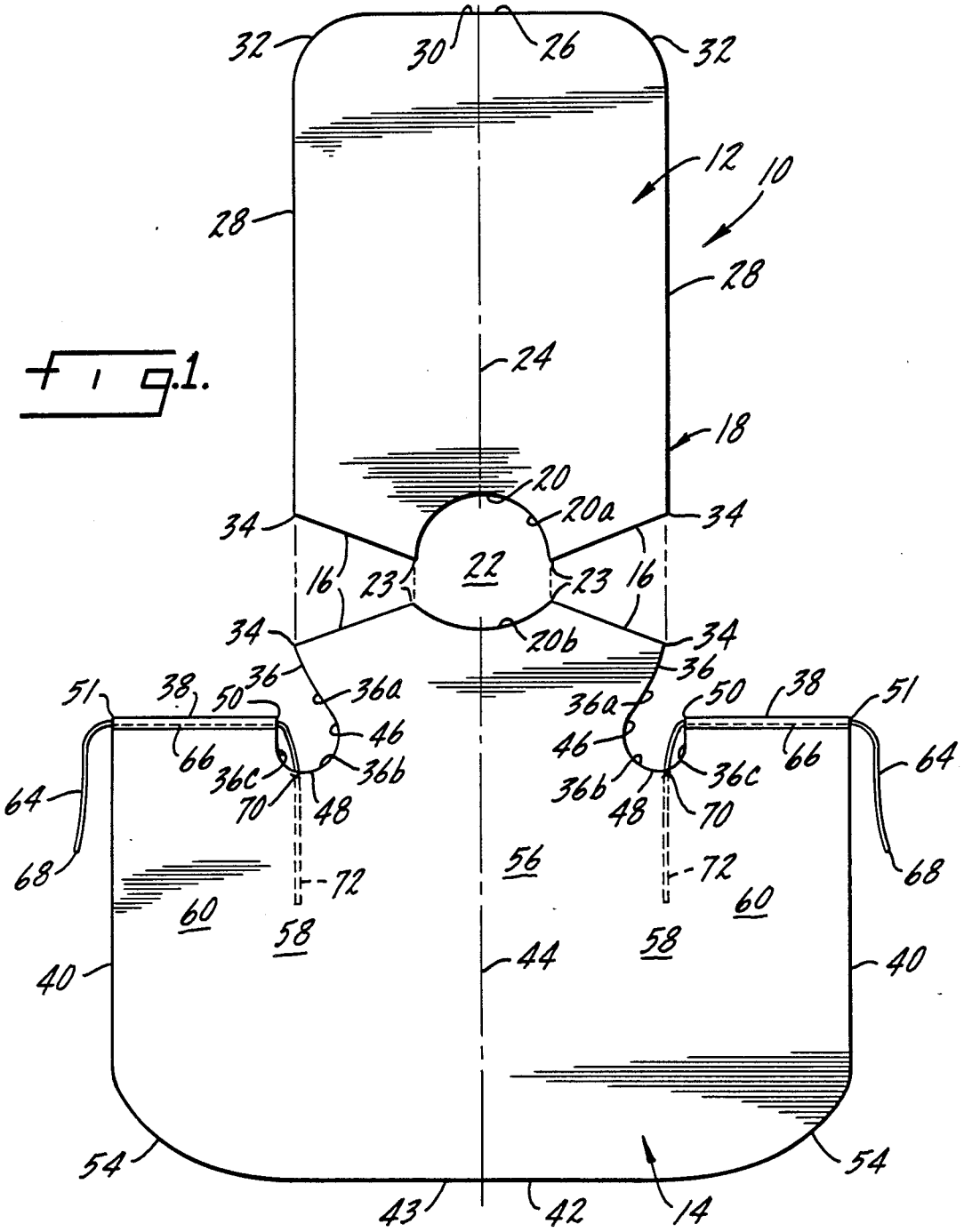
FIG. 1 is a plan view of the underside of the garment of the present invention, with the two panels separated at their seam lines for clarity of illustration.

A one-piece garment embodying the principles of the present invention is illustrated in FIGS. 1–6. As shown in FIG. 1, the garment 10 defines a one-piece gown suitable for use as a hospital gown, painting smock, and the like. In the illustrated embodiment, the garment 10 is made of two panels, a first panel 12 and a second panel 14. The two panels 12 14 are sewn together along seam lines 16. The seam lines 16 extend inwardly from the peripheral edge 18 of the garment to the interior neck edge 20 of a neck opening 22. The neck opening 22 is disposed between the two panels 12, 14, spaced from the peripheral edge 18 of the garment.

Each panel 12, 14 of the illustrated garment 10 comprises a continuous sheet of woven textile fabric, although pieces of fabric could be sewn together to form the panels. The type of fabric chosen for the garment will depend upon its intended end use. For a hospital gown, the fabric should be capable of withstanding repeated high-temperature laundering, and should provide comfort to the bedridden wearer. For a hospital gown, a fabric such as that described in U.S Pat. No. 4,771,480 to Stimson et al., may be used: a woven fabric which has about 180 threads per square inch, and which is formed of yarns comprising a blend of cotton and polyester fibers, the preferred blend being 65% polyester fibers and 35% cotton fibers, the fabric being of an institutional, or pure, finish, with no resin. Thread should, if possible, be of a blend equivalent to the other materials used for the panels. For a garment to be worn by pediatric patients, the fabric chosen should meet all guidelines and standards for fire retardance. A fabric comprising 100% polyester fibers with suitable flame retardant chemical treatment may be used for children's hospital gowns.

The illustrated garment 10 is made by cutting out the first and second panels 12, 14 from sheets of fabric, finishing the edges of the panels, and sewing the two panels together along the seam lines. The peripheral edge 18 and interior neck edge 20 of the garment are preferably finished by serging, although all of the edges could be hemmed.

The neck opening 22 defined by the interior neck edge 20 is illustrated in FIG. 1. As shown, the neck opening is curved and extends into both the first 12 and second 14 panels, with the neck edge having a first part **20*a* in the first panel 12 and a second part 20*b* in the second panel. The first and second parts 20*a*, 20*b* of the neck edge 20 meet at the inner ends 23 of the seam lines 16. In the illustrated embodiment, the first panel 12 serves as the front panel of the garment, although it should be understood that the garment could be reversed with the first panel serving as the back panel of the garment. The first panel 12 has a longitudinal centerline 24 along the length of the panel, bisecting the first part 20*a* of the neck edge 20**.

On the first panel 12, the garment's peripheral edge 18 includes a first bottom edge 26 and a first pair of spaced side edges 28. The first bottom edge 26 has a substantially straight centrally-disposed segment 30 which is perpendicular to and bisected by the longitudinal centerline 24 of the first panel 12. The ends 32 of the illustrated first bottom edge 26 curve upwardly to meet the first side edges 28. The first side edges 28 extend from the ends of the first bottom edge 26 upwardly to the outer ends 34 of the seam lines 16. The first side edges are substantially parallel to the longitudinal centerline 24.

At the outer ends 34 of the seam lines 16, the first side edges 28 connect with the peripheral edge of the second panel 14. The peripheral edge of the second panel includes a pair of spaced axillar edges 36, a pair of transverse edges 38, a second pair of spaced side edges 40 and a second bottom edge 42 spaced from the second part **20*b* of the neck edge 20. The second bottom edge 42 has a substantially straight centrally-disposed segment 43. The second panel 14 also has a longitudinal centerline 44 which extends between and bisects the second part 20*b* of the neck edge 20 and the substantially straight segment 43 of the second bottom edge 42. The longitudinal centerline 44 is perpendicular to the straight segment 43 of the second bottom edge and divides the second panel 14** into mirror image halves.

As shown in FIG. 1, the axillar edges 36 of the second panel 14 are spaced from each other and extend from the first side edges 28 at the outer ends 34 of the seam lines 16. From the seam lines, the axillar edges have converging segments **36*a* which extend from the first side edges 28 towards the second bottom edge 42, converging toward the longitudinal centerline 44 to proximate points 46. From the proximate points 46, the axillar edges have diverging segments 36*b* which extend toward the bottom edge 42, diverging from the longitudinal centerline 44 to low points 48. From the low points 48, the axillar edges have terminal segments 36*c* which extend away from the bottom edge 42 and from the longitudinal centerline 44 to termination points 50. The two axillar edges 36 are generally hook shaped, with the termination points 50** defining the ends of the hooks.

The termination points 50 of the axillar edges 36 define the inner ends of the transverse edges 38. From the inner ends at the termination points 50, the transverse edges 38 extend outwardly, away from the longitudinal centerline, to outer ends 51 at the second pair of side edges 40. The second pair of side edges 40 extends between the transverse edges 38 and the second bottom edge 42. The second bottom edge 42 has curved end segments 54 which connect the substantially straight segment 43 of the bottom edge and the second side edges 40.

The second panel 14 defines a central panel 56, a pair of spaced side panels 58 and a pair of spaced transverse panels 60. The central panel 56 includes the area of the second panel 14 from the second part **20*b* of the neck edge 20 and seam lines 16 and the converging segments of the axillar edges 36 to the proximal points 46 down to the second bottom edge 42. The two side panels 58 are disposed along the sides of the central panel 56 and extend between the second bottom edge 42 and the diverging 36*b* and terminal 36*c* segments of the axillar edges 36 between the proximal points 46 and the termination points 50. The transverse panels 60 are disposed along the sides of the side panels 58 and extend between the transverse edges 38 and second bottom edge 42 and between the second side edges 40 and the side panels 58**.

Figure 3:
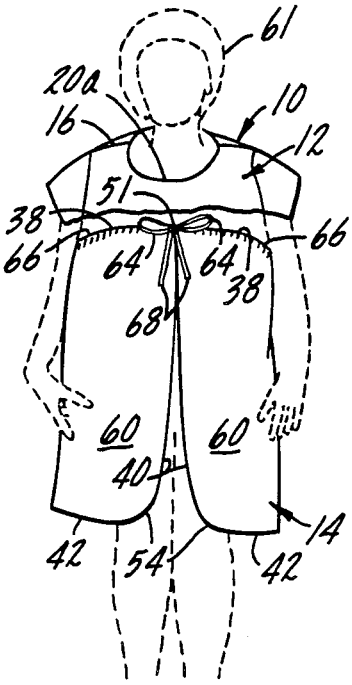
FIG. 3 is a front view of the garment of the present invention as worn, with a portion of the first panel removed to show one means of closing the second panel.
Figure 4:
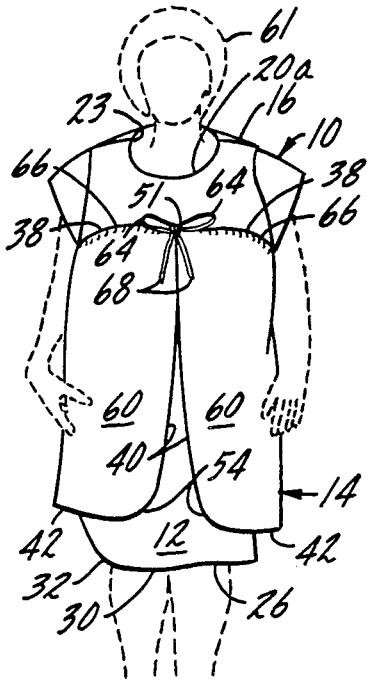
FIG. 4 is a front view of the garment of the present invention as worn in an alternate manner, with the second panel closed over the top of the first panel.
Figure 6:
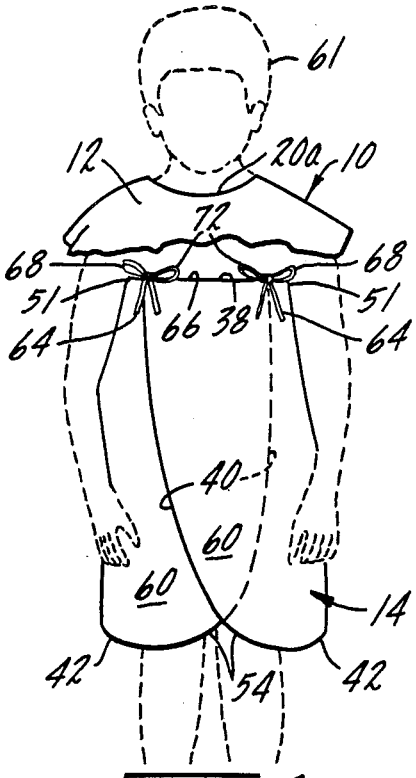
FIG. 6 is a front view of the garment of the present invention as worn by a child, with a portion of the first panel removed to show an alternate means of closing the second panel under the first panel.

The second panel 14 in the illustrated embodiment is adapted to wrap around the wearer 61. The central panel 56 of the second panel 14 covers the shoulders and back of the wearer 62. In a hospital gown as illustrated, the central panel is long enough to extend below the wearer's buttocks. The wearer's sides, from beneath the wearer's armpits, are covered by the side panels 58. The transverse panels 60 cover at least a substantial part of the front of the wearer, as shown in FIGS. 3, 4 and 6. The front torso of the wearer is completely covered by the combination of the transverse panels 60 and first panel 12.

The axillar edges 36 in the illustrated embodiment are shaped to fit behind the junctions of the wearer's arms and shoulders at the proximate points 46, beneath this junction at the low points 48, and in front of this junction at the termination points 50. The hook shape of the illustrated axillar edges provide's a smooth curve around these junctions and also serves to position the transverse edges 38 properly, so that the wearer's breasts are adequately covered. As shown in FIG. 1, the termination points 50 of the axillar edges, and thus the inner ends of the transverse edges, are more proximate to the neck edge 20 than are the low points 48. Thus, the transverse edges 38 are positioned at the fronts of the junctions of the wearer's arms and shoulders, positions high enough on the wearer's chest to adequately cover the breasts.

As shown in FIGS. 3, 4 and 6, the transverse panels 60 and transverse edges 38 are adapted to extend substantially across the chest of the wearer. The garment also includes closure means for positioning the transverse edges and transverse panels with respect to each other, substantially at the chest level of the wearer.

The garment of the present invention can be reversed, with the central panel 56 covering the wearer's chest, the transverse panels 60 covering a substantial part of the wearer's back and the first panel 12 lying over or under the transverse panels. Thus, the first panel 12 generally serves to cover one aspect of the wearer's torso, either the front aspect of the torso as shown in FIGS. 2–6, or the back aspect of the torso, extending inferiorly, that is, away from the head, from the first part 20*a* of the neck edge 20. The central panel 56 serves to cover the opposite aspect of the wearer's torso inferiorly from the second part 20*b* of the neck edge 20. The side panels 58 serve to cover the sides of the wearer's torso inferiorly from under the wearer's armpits. The transverse panels 60 extend medially, that is, toward the wearer's midline, from the side panels 58, and serve to cover a portion of the first aspect of the wearer's torso, inferiorly from the wearer's thorax.

In the illustrated embodiment, the closure means allows the transverse panels to be positioned in two ways, depending upon the size and preference of the wearer, thereby making the garment more versatile and adaptable for use on wearers of varying body size. For wearers with larger girths, the transverse panels may be closed as shown in FIGS. 3 and 4, with the transverse panels positioned in a side by side relationship, the outer ends 51 of the transverse edges being connected to each other by the closure means. The outer ends 51 of the transverse edges 38 need not touch in order to adequately cover the wearer's front torso, for the overlying first panel 12 will cover a gap between the transverse panels. For wearers with smaller girths, the transverse panels may alternatively be positioned as shown in FIG. 6, with one transverse panel overlying the other transverse panel.

The illustrated closure means forms tieing means near the outer ends 51 of the transverse edges and near the axillar edges 36. As shown in FIG. 1, the tieing means comprises a pair of ties 64 extending through sleeves 66 formed along the lengths of the transverse edges 38. Each tie 64 is attached to the second panel 14 proximate to the low points 48 on the axillar edges 36. One free end 68 of each tie 64 extends from the point of attachment 70, through the sleeve 66, and extends out of the sleeve. A second free end 72 hangs loosely down from the point of attachment 70. For the comfort of the wearer, it is preferred that the second free end 72 of the tie 64 hang on the outside of the garment, away from the wearer's skin.

With the illustrated closure means, the transverse panels 60 may be secured in position by tieing the first free ends 68 of the ties together across the wearer's chest in a draw-string manner, as shown in FIGS. 3 and 4. The transverse edges 38 can then be adjusted along the ties to maximize coverage of the front of the wearer. Alternatively, one transverse panel 60 can be crossed over the other transverse panel, and the first free end 68 of each tie 64 can be tied to the second free end 72 of the other tie, as shown in FIG. 6.

Attaching the ties 64 near to the low points 48 of the axillar edges 36 adds to the versatility of the garment. When the transverse panels are closed by tieing the first free ends 68 of the ties together, the transverse edges 38 and terminal segments 36*c* of the axillar edges may all be gathered along the ties.

Removal of the garment for changing or for emergency treatment is quick and simple with the illustrated closure means. Only one or two ties must be untied to completely expose the wearer's chest and abdomen. Because the ties may be used on the front sides of the wearers, wearers may untie the ties on their own, and hospital personnel may untie them without turning bedridden patients over on their sides.

Other types of closure means could be employed to position and secure the transverse edges and panels. For example, hook and loop closure means, such as "Velcro", could be secured to the transverse edges to close one transverse panel over the other transverse panel. Buttons or snap could be used. Different types of ties could also be employed: for example, one tie could be secured to the outer end 51 of each transverse edge, and a second tie secured to each axillar edge 36.

Figure 2:
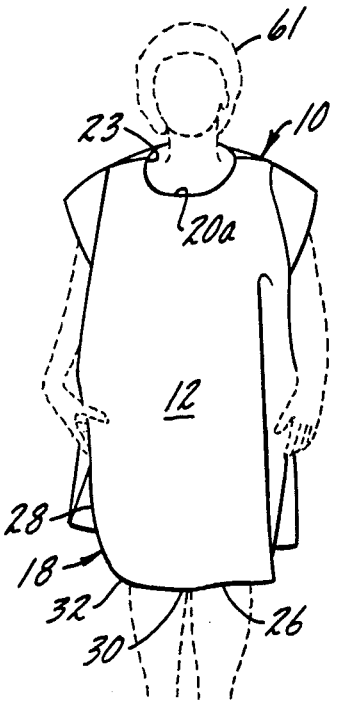
FIG. 2 is a front view of the garment of the present invention as worn.
Figure 5:
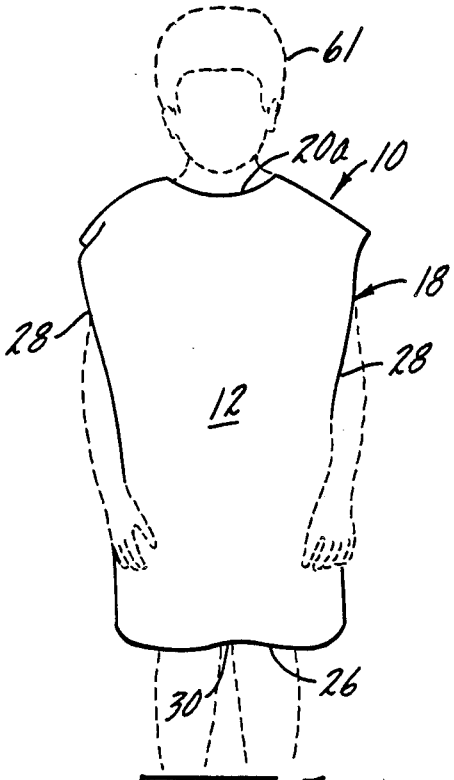
FIG. 5 is a front view of the garment of the present invention as worn by a child.

As shown in FIGS. 2 and 5, the first panel generally overlies the closed transverse panels 60. Thus, the garment fully covers the wearer chest, back and shoulders. The overall length of the garment will vary with the intended end use. For a hospital gown, the garment should be long enough to cover the wearer's torso. However, shorter garments could also be used, for example, as a protective shirt. FIGS. 3 and 4 illustrate that the transverse panels 60 may be closed either under the first panel 12 or over the first panel, depending upon personal preference.

The sizes, proportions and shapes of the panels 12, 14 contribute to the versatility and utility of the garment. Especially for the female wearer, it is desirable that the transverse edges extend substantially across the wearer's breasts so that the breasts are adequately covered. In a hospital gown, the transverse edges must be long enough, the transverse panels and side panels must be wide enough, and the entire garment must be long enough to adequately cover the wearer's torso.

To ensure that the transverse panels are long enough to adequately cover the torso of the wearer, the lengths of the transverse panels 60 and second side edges 40 are at least about one-third the overall length of the garment, measured from the straight segment 30 of the first bottom edge 26, across the neck opening 22, to the straight segment 43 of the second bottom edge 42. Preferably, the transverse panels should be long enough to extend down from the front of the junctions of the wearer's arms and shoulders.

To ensure that the width of the garment is adequate to wrap around the wearer, the combined widths of the transverse panels 60 and side panels 58 should be greater than the width of the central panel 56; preferably, the combined lengths of the transverse edges 38 should be at least as great as the distance between the proximate points 46 on the axillar edges 36. In the illustrated embodiment, the overall width of the second panel, between the second side edges 40, is more than twice the distance between the proximate points 46 on the central panel. These relationships ensure that the second panel is at a minimum wide enough to wrap around and cover the wearer's back, sides, and a substantial part of the wearer's front when the wearer is standing, sitting or lying down. In combination with the first panel, the wearer should be adequately covered.

In a hospital gown to be worn by an adult, appropriate dimensions for the garment may be as follows. In the illustrated embodiment, the overall length of the garment, from the first bottom edge to the first part of the neck edge, across the neck opening and from the second part of the neck edge to the second bottom edge is about 81–82 inches.

The first panel 12 has a length of about 39 and $\frac{5}{8}$ inches measured from the straight segment 30 of the first bottom edge 26 to the inner ends 23 of the seam lines 16. The first side edges 28 have lengths of 32 inches measured from the outer ends 34 of the seam lines 16 to the ends of the curved segments 32 of the first bottom edge 26; the distance between the outer ends 34 of the seam lines and the line of the straight segment 30 of the first bottom edge 26 is about 36 and $\frac{1}{2}$ inches. These first side edges 28 are parallel to each other and spaced apart by a transverse distance of about 27 inches. The straight segment 30 of the first bottom edge 26 has a length of about 15 inches.

The second panel 14 has an overall length of about 42 inches, measured from the inner ends 23 of the seam lines 16 to the straight segment 43 of the second bottom edge 42. The overall width of the second panel, measured between the second side edges 40, is about 53 inches. The central panel 56 is about 27 inches wide between the junctures of the axillar edges 36 and the outer ends 34 of the seam lines 16, and about 20 inches wide between the proximate points 46. Each side panel 58 is about 4 and $\frac{1}{4}$ inches wide, and each transverse edge 38 is about 12 inches wide. Each second side edge 40 measures about 27 inches from the outer end 51 of the transverse edge 38 to the curved segment 54 of the second bottom edge 42, and about 34 inches to the line of the straight segment 52 of the second bottom edge 42.

Although not critical, it is preferred that the seam lines 16 be angled with respect to the side edges 28, 40 of both panels 12, 14 to allow the garment to lie relatively flat on the wearer's shoulders. In the illustrated embodiment, the seam lines define an angle of about 112 degrees with the first side edges 28. The seam lines similarly define angles of about 107–110 degrees with respect to the second side edges 40.

The neck opening 22 should be sized and shaped to allow the front panel to be easily lifted over the wearer's face and the top of the wearer's head. In the illustrated embodiment, the adult-sized neck opening is about 9 and $\frac{1}{2}$ to 10 inches wide between the inner ends 23 of the seam lines 16. The illustrated neck opening extends about 5 inches into the first panel 12 at the longitudinal centerline 24, and about 1 and $\frac{1}{2}$ inches into the second panel 14 at the longitudinal centerline 44. The radius of curvature of the second part **20*b* of the neck edge is greater than that of the first part 20*a*** of the neck edge.

Each tie 64 is about 35 inches long in the adult-sized garment. The first free end 68 of each tie is about 25 and $\frac{1}{2}$ inches long, and the second free end is about 9 and $\frac{1}{2}$ inches long.

The ties 64 may be made from a variety of materials, including the same fabric used to make the panels of the garment, in which case the fabric may be cut to an appropriate length and sewn into a long, flat tube. However, it is preferred that strips of fabric tape be used for the ties.

The dimensions given are intended to be illustrative only. Other dimensions should be used, for example, for children's garments. Other dimensions may also be used for adult sized garments.

For a pediatric hospital gown, the dimensions of the gown should be about three-fourths of the adult size. For a gown for toddlers, ages 1–2 years, the gown should be about two and one-thirds times smaller than the adult size, although the length of the ties should remain about the same as that used in the pediatric size or the ties may be too short to tie easily.

In use, the wearer's head is placed through the neck opening, generally with the first panel overlying the patient's front. The second panel is then wrapped around the wearer's back and sides, and the transverse panels are brought over the wearer's chest, either over or under the first panel, and closed by either the draw string method or by crossing one transverse panel over the other and tying the ties together.

For the hospital patient, the garment allows quick access to the chest area, simply by lifting the first panel. Changing the garment to a fresh garment is simplified for hospital personnel, since they need not free the patient's arms from intravenous connections. And since the garment fully covers the patient's torso, the ambulatory patient is free to walk about without fear of exposure.

Other features, such as pockets, may be added to the garment, depending upon personal preferences and the intended end use. For example, it may be desirable to include a pocket on a hospital gown to be used by cardiac patients to hold a small portable monitor; such a pocket could be provided on either the first panel or on one of the transverse panels.

Although the invention has been described with respect to the illustrated embodiments, the invention is not limited to these embodiments. Additional modifications and/or additions may be included by those skilled in the art without departing from the scope of the invention as defined by the claims.

I claim:

1. A one-piece garment comprising first and second panels defining an interior neck opening between the two panels through which the wearer's neck may extend, the garment further comprising:

an interior neck edge around the neck opening, the neck edge having first and second parts on the first and second panels;

a peripheral edge extending around the first and second panels, the peripheral edge including a first bottom edge and a first pair of spaced side edges extending from the first bottom edge, a second bottom edge disposed opposite to the first bottom edge, a pair of spaced axillar edges extending from the first panel side edges, a pair of transverse edges extending from the axillar edges, and a second pair of spaced side edges extending from the transverse edges to the second bottom edge;

wherein the first panel extends longitudinally between the first part of the neck edge and the first bottom edge and transversely between the first pair of side edges, the first panel being adapted to cover the wearer's chest;

wherein the second panel further includes a central panel, a pair of spaced side panels and a pair of spaced transverse panels, the central panel extending longitudinally between the second part of the neck edge and the second bottom edge and transversely between segments of the axillar edges and between the side panels, the pair of side panels extending longitudinally between segments of the axillar edges and the second bottom edge and transversely between the central panel and the transverse panels, and the pair of transverse panels extending longitudinally between the transverse edges and the second bottom edge and transversely between the side panels and the second pair of side edges;

the central panel being adapted to cover the wearer's back and shoulders from the neck edge to the second bottom edge, the side panels being adapted to cover the wearer's sides from under the wearer's armpits down to the bottom edge, and the transverse panels being adapted to substantially cover the wearer's chest;

the garment further including closure means for positioning the transverse panels substantially across the wearer's chest;

2. A garment as claimed in claim 1 wherein the first and second panels are dimensioned to cover the wearer's torso.

3. A garment as claimed in claim 1 wherein the axillar edges are adapted to extend behind, under and in front of the junctions of the wearer's arms and shoulders and the transverse edges are adapted to extend substantially across the wearer's chest from the fronts of the junctions of the wearer's arms and shoulders.

4. A garment as claimed in claim 1 wherein the transverse panels are dimensioned so that one transverse panel may be crossed over the other transverse panel across the wearer's chest and the closure means positions one transverse panel overlying the other transverse panel

5. A garment as claimed in claim 4 wherein each transverse edge has an outer end at the junction of the transverse edge and second side edge, and the closure means includes tieing means disposed near the outer end of each transverse edge and near the axillar edge so that the tieing means near the outer end of each transverse edge may be tied to the tieing means near the axillar edge of the other transverse panel.

6. A garment as claimed in claim 1 wherein the closure means includes a set of ties, each tie being attached to the second panel of the garment and having first free ends extending through sleeves along the transverse edges, and wherein the free ends of the ties may be tied together across the wearer's chest to position the transverse panels in a side by side relationship.

7. A garment as claimed in claim 6 wherein the closure means alternatively allows for closing the garment with the transverse panels in an overlapping relationship, and wherein each tie is attached to the second panel proximate to the axillar edges, and the ties further include second free ends extending from the points of attachment, so that the transverse panels may be positioned by crossing one transverse panel over the other transverse panel and tieing the first free end of each tie to the second free end of the other tie.

8. A garment as claimed in claim 7 wherein the garment has an overall length extending from the first bottom edge to the first part of the neck edge, across the neck opening, and from the second part of the neck edge to the second bottom edge, and each transverse panel has a length defined by the distance between the transverse edge and the second bottom edge, and the length of each transverse panel is at least one-third of the overall length of the garment, and wherein the second panel has an overall width extending between the second pair of side edges and the distance between the side panels across the central panel is less than one-half of the overall width of the second panel.

9. A garment as claimed in claim 1 wherein the garment has on overall length extending from the first bottom edge to the first part of the neck edge, across the neck opening, and from the second part of the neck edge to the second bottom edge, and each transverse panel has a length defined by the distance between the transverse edge and the second bottom edge, and the length of each transverse panel is at least one-third of the overall length of the garment.

10. A garment as claimed in claim 1 wherein the second panel has an overall width extending between the second side edges and the overall width is at least twice the distance between the side panels across the central panel.

11. A garment as claimed in claim 1 wherein the first and second panels are joined together along seam lines extending from opposing points on the neck edge to the junctures of the first side edges and axillar edges.

12. A garment as claimed in claim 1 wherein each transverse edge has a length of about 12 inches and each second side edge has a length of at least about 27 inches.

13. A garment as claimed in claim 1 wherein the second panel comprises a single sheet of fabric.

14. A one-piece garment having a peripheral edge and an interior neck edge defining a neck opening, the interior neck edge being spaced from the peripheral edge, the garment further comprising:

a first bottom edge spaced from the interior neck edge;

a second bottom edge disposed opposite to the first bottom edge and spaced from the interior neck edge;

a longitudinal centerline intersecting the second bottom edge and the interior neck edge;

a first pair of spaced side edges extending from the first bottom edge toward the interior neck edge;

a pair of spaced axillar edges having converging segments extending from the first side edges proximate to the interior neck edge toward the second bottom edge and converging toward the longitudinal centerline to proximate points, diverging segments extending from the proximate points toward the second bottom edge and diverging from the longitudinal centerline to low points, and terminal segments extending from the low points away from the second bottom edge and away from the longitudinal centerline to termination points, the termination points of each axillar edge being more proximate to the neck edge than are the low points of each axillar edge;

a pair of transverse edges having inner ends at the termination points of the axillar edges and extending from the inner ends away from the longitudinal centerline;

a second pair of spaced side edges extending between the outer ends of the transverse edges and the second bottom edge; and closure means for positioning the transverse edges with respect to each other.

15. A garment as claimed in claim 14 wherein the distance between the second pair of side edges is at least twice the distance between the proximate points.

16. A garment as claimed in claim 14 wherein the overall length of the garment is measured from the first bottom edge to the neck edge, across the neck opening and from the neck edge to the second bottom edge, and the distance between the inner ends of the transverse edges and the second bottom edge is at least one-third of the overall length of the garment.

17. A garment as claimed in claim 14 wherein the lengths of the transverse edges are substantially the same and the combined lengths of the two transverse edges is at least as great as the distance between the proximate points.

18. A garment as claimed in claim 14 wherein the closure means includes tieing means disposed near the outer end of each transverse edge and near the axillar edge so that the tieing means near the axillar edge can be tied to the tieing means near the outer end of the other transverse edge to secure one transverse edge in position overlying the other transverse edge.

19. A garment as claimed in claim 18 wherein the closure means provides alternative ways of positioning the transverse edges, the tieing means including a set of ties attached to the garment proximate to the axillar edges, each tie having a first free end extending through a sleeve along each transverse edge and a second free end extending from the point of attachment of the tie to the garment, so that the transverse edges can be secured with one transverse edge in position overlying the other transverse edge by tieing the first free end of each tie to the second free end of the other tie and alternatively can be secured with the transverse edges in a side by side relationship by tieing the first free ends of the ties together.

20. A garment as claimed in claim 19 wherein each tie is attached to the garment near to the low point of each axillar edge.

21. A garment as claimed in claim 14 wherein the closure means includes a set of ties attached to the garment proximate to the axillar edges, each tie having a first free end extending from its point of attachment through a sleeve along each transverse edge and exiting the sleeve near to the outer end of each transverse edge so that the transverse edges can be positioned by tieing the free ends of the ties together.

22. A garment as claimed in claim 21 wherein each tie is attached to the garment near to the low point of each axillar edge.

23. A garment as claimed in claim 14 wherein the transverse edges are substantially perpendicular to the longitudinal centerline.

24. A one-piece garment comprising first and second panels defining an interior neck opening between the two panels through which the wearer's neck may extend, the garment further comprising:

an interior neck edge around the neck opening, the neck edge having first and second parts on the first and second panels;

a peripheral edge extending around the first and second panels, the peripheral edge including a first bottom edge, a first pair of spaced side edges extending from the first bottom edge, a second bottom edge disposed opposite to the first bottom edge, a pair of spaced axillar edges extending from the first side edges, a pair of transverse edges extending from the axillar edges, and a second pair of spaced side edges extending from the transverse edges to the second bottom edge;

the first panel extending longitudinally between the first part of the neck edge and the first bottom edge and transversely between the first pair of side edges to cover one side of the wearer's torso inferiorly from the first part of the neck edge;

wherein the second panel further includes a central panel, a pair of spaced side panels and a pair of spaced transverse panels, the central panel extending longitudinally between the second part of the neck edge and the second bottom edge and transversely between segments of the axillar edges and between the side panels for covering the opposite side of the wearer's torso inferiorly from the second part of the neck edge, the pair of side panels extending longitudinally between segments of the axillar edges and the second bottom edge and transversely between the central panel and the transverse panels for covering the sides of the wearer's torso inferiorly from under the wearer's armpits, and the pair of transverse panels extending longitudinally between the transverse edges and the second bottom edge and transversely between the side panels and the second pair of side edges for covering a portion of one side of the wearer's torso;

the garment further including closure means for positioning the transverse panels so that the transverse panels cover a portion of one side of the wearer's torso inferiorly from the thoracic level of the wearer's torso.

25. A garment as claimed in claim 24 wherein the garment has an overall length extending from the first bottom edge to the first part of the neck edge, across the neck opening, and from the second part of the neck edge to the second bottom edge, and each transverse panel has a length defined by the distance between the transverse edge and the second bottom edge, and the length of each transverse panel is at least one-third of the overall length of the garment.

26. A garment as claimed in claim 24 wherein the means for positioning the transverse panels secures one transverse panel in position overlying the other transverse panel.

27. A garment as claimed in claim 24 wherein the transverse edges have outer ends at the junctures of the transverse edges and the second pair of side edges and the means for positioning the transverse panels includes tieing means disposed near the axillar edges and the outer ends of the transverse edges so that the tieing means may be tied together to secure the transverse panels in position with one transverse panel overlying the other.

28. A garment as claimed in claim 27 wherein the tieing means provides for alternative ways of positioning the transverse panels and includes a set of ties attached to the garment proximate to the axillar edges, each tie having a first free end extending from each point of attachment through a sleeve along each transverse edge and exiting the sleeve near the outer end of the transverse edge, and a second free end extending from the point of attachment so that the transverse panels can be positioned by tieing the first free ends of the ties together and can alternatively be positioned by crossing one transverse panel over the other transverse panel and tieing the first free end of each tie to the second free end of the other tie.

29. A garment as claimed in claim 24 wherein the transverse panels have outer ends at the junctures of the transverse edges and the second side edges and the means for positioning the transverse panels includes a set of ties attached to the garment proximate to the axillar edges, the ties having first free ends extending from the points of attachment through sleeves along the transverse edges to the outer ends of the transverse edges so that the transverse panels may be positioned by tieing the first free ends of the ties to each other.

30. A garment as claimed in claim 24 wherein the second panel comprises a single sheet of fabric.

31. A garment as claimed in claim 24 wherein the central panel is adapted to cover the wearer's chest, the side panels are adapted to cover the wearer's sides from under the wearer's armpit, the transverse panels are adapted to extend medially and inferiorly from the junctions of the wearer's arms and shoulders, and the first panel is adapted to cover the wearer's back.

32. A garment as claimed in claim 24 wherein the central panel functions to cover a back side of the wearer's torso inferiorly from the neck edge, and the transverse panels function to cover a portion of the front aspect of the wearer's torso inferiorly from the wearer's chest.

* * * * *